United States Patent [19]

Daniel

[11] 3,957,134

[45] May 18, 1976

[54] ACOUSTIC REFRACTORS

[76] Inventor: Donald D. Daniel, 57A Decatur, Ridgecrest, Calif. 93555

[22] Filed: Dec. 9, 1974

[21] Appl. No.: 530,727

[52] U.S. Cl. ..... 181/176
[51] Int. Cl.[2] ..... G10K 11/00
[58] Field of Search..... 181/175, 176, 159

[56] References Cited

UNITED STATES PATENTS

| | | | |
|---|---|---|---|
| 2,684,724 | 7/1954 | Kock | 181/176 |
| 2,848,058 | 8/1958 | Hartsfield | 181/176 |
| 3,027,964 | 4/1962 | Spragins | 181/176 |
| 3,303,904 | 2/1967 | Kelly | 181/176 |
| 3,467,218 | 9/1969 | Fujimoto et al. | 181/175 |

*Primary Examiner*—L. T. Hix
*Assistant Examiner*—Vit W. Miska

[57] ABSTRACT

A refracting structure with passages of different shapes with some separation of adjacent passages provides a minimum of sound reflections. It can be designed in the form of spherically divergent lenses with passages with cross sections in the form of squares or of concentric circular slits, a cylindrically divergent lens with slit shaped passages, and in other forms. Stagger of ends of the passages is discussed.

16 Claims, 11 Drawing Figures

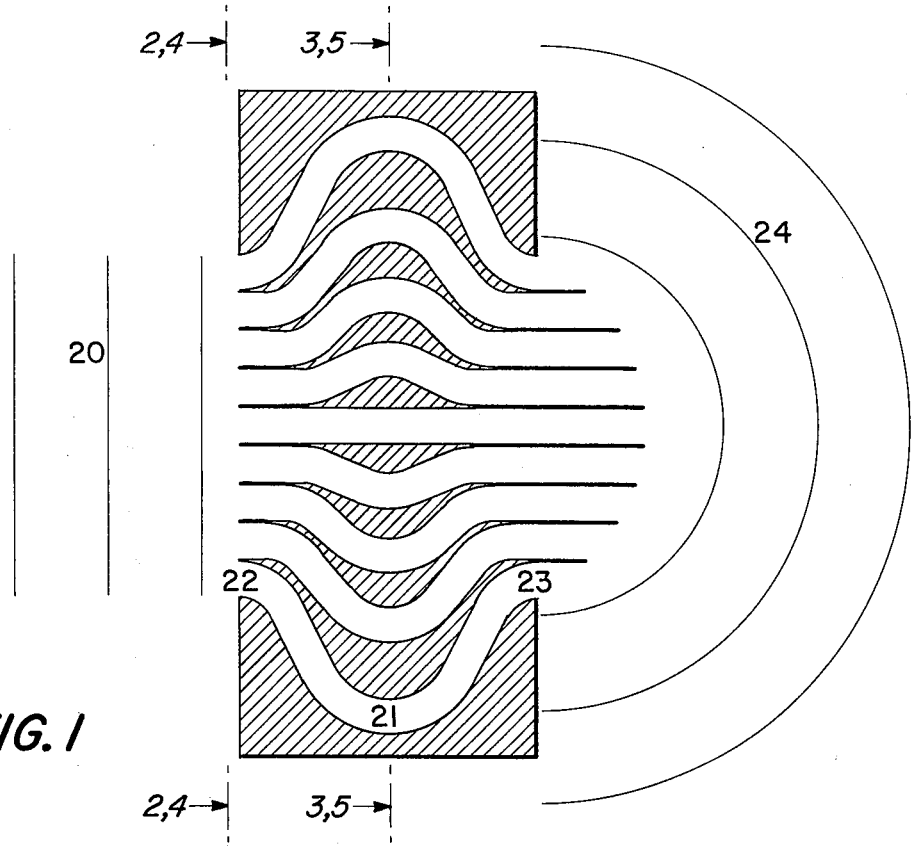
FIG. 1
FIG. 2
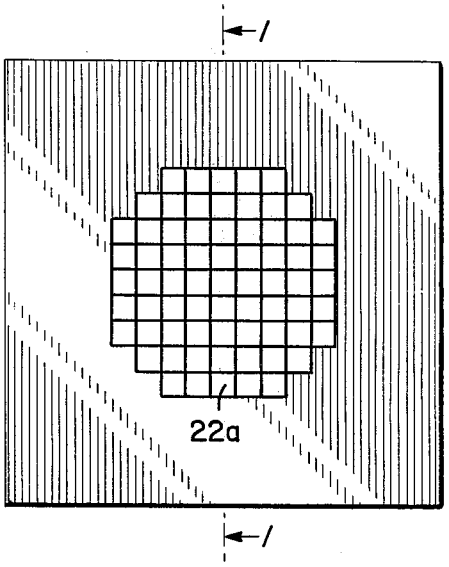
FIG. 3
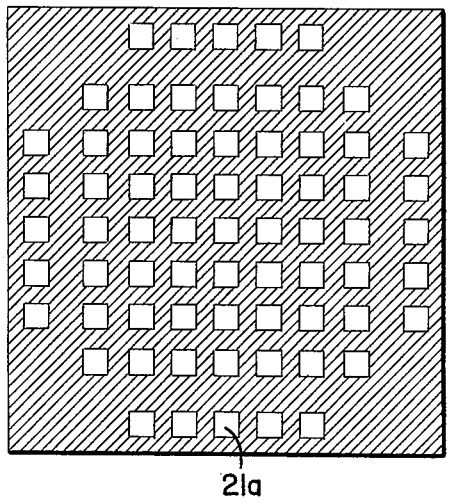

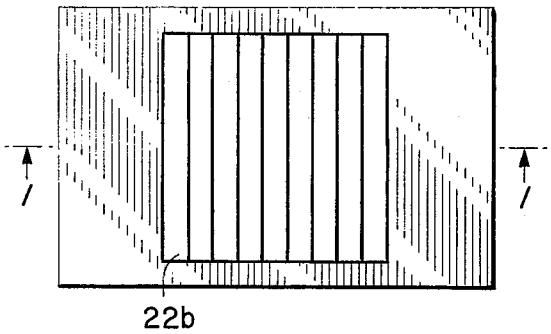
FIG. 4
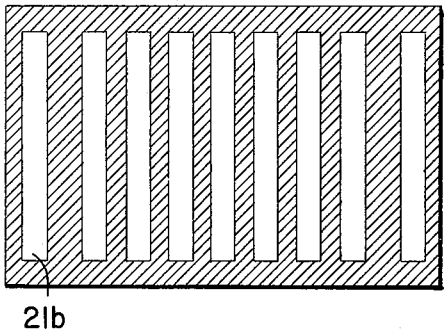
FIG. 5
FIG. 6
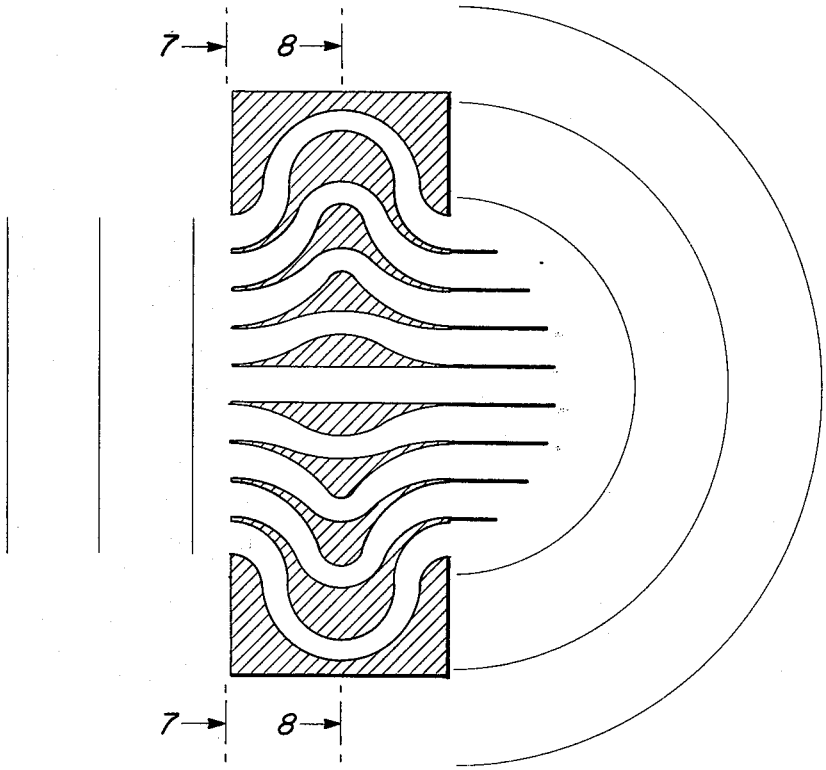

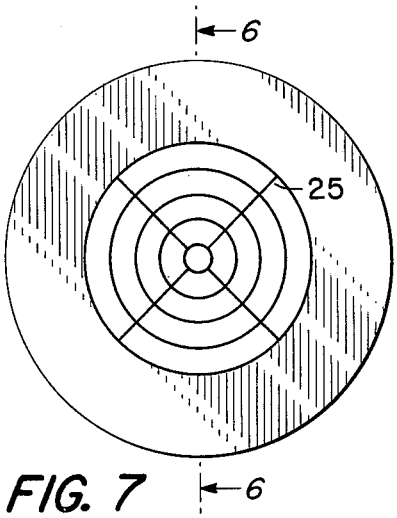
FIG. 7
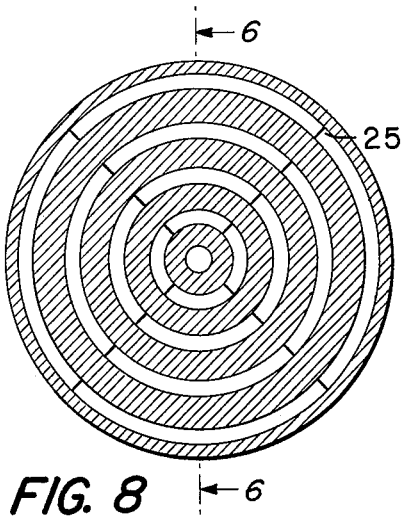
FIG. 8
FIG. 9
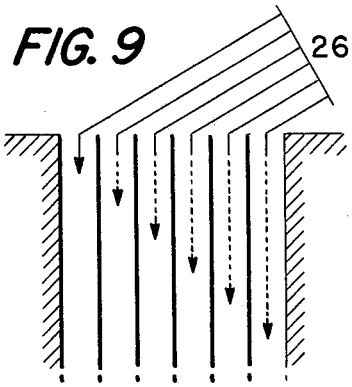
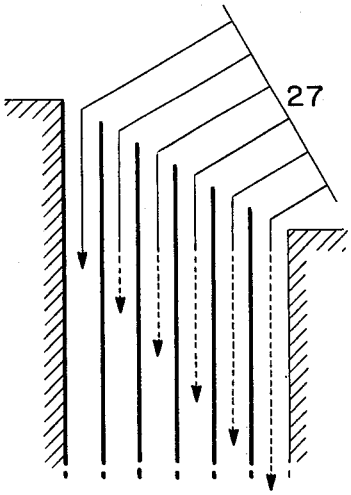
FIG. 10
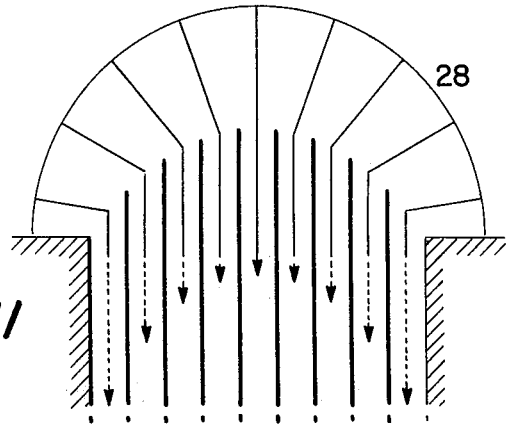
FIG. 11

ACOUSTIC REFRACTORS

BACKGROUND OF THE INVENTION

1. Field of the Invention

The present invention is a means of controlling the directional properties of sound. More specifically the invention is a means of altering the shape and direction of a wave front by providing separate delaying paths for different parts of the wavefront, which causes refraction of the wave where the paths recombine.

Devices used to control the directional properties of sound fall mainly into two categories: devices to increase the directivity of microphones, and devices to decrease the directivity of loudspeakers. The present invention falls mainly into this latter category. A third, structurally related category is represented by the acoustic delay line, which preserves the directional properties of an acoustic wave while displacing it in time and space.

2. Description of the Prior Art

Acoustic refractors that were known heretofore, such as the slant plate, perforated plate and corrugated plate varieties, cause reflections of the wave when it enters the refractor, and again when it emerges from the refractor. The acoustic refractor herein disclosed is designed to produce smaller reflections than previous refractors, and can more conveniently be arranged to provide large refraction angles.

SUMMARY OF THE INVENTION

The present invention is a sound wave refractor which causes a minimum of reflections in a sound wave as it enters, passes through, and emerges from the refractor.

The refractor is a structure provided with a plurality of sound passages each of which is of uniform or slowly varying cross section from its entrance to its exit so as to avoid reflections for the range of wavelengths to be used with the refractor. The passages are nested together in the region of their entrances and also in the region of their exits, so as to avoid reflections from abrupt changes in cross sectional area upon splitting up the wavefront at the entrance, or upon recombining it at the exit of the refractor. The variations in time delay of different parts of a wavefront traversing the refractor which are necessary to produce refraction are provided by some of the passages following paths of different shapes, with separation from some of their neighboring passages at points between the regions where the passages are nested together at the ends. The paths followed are preferably smooth curves to avoid reflections, but sharp bends within the passages are permissible provided the cross section of the passage is the same immediately before and after the bend.

In order to provide frequency independent refraction with a large angle of refraction the appropriate dimension of the exit ends of the passages must be less than half of the shortest wavelength to be refracted, so that the wavelets emerging from the exit ends will diffract over a wide angle so as to interefere with each other sufficiently to permit the desired refraction.

The exit ends of the passages are preferably staggered so as to minimize the discontinuity in the sound path cross section at the exit, and to allow the contributions of various passages to the wavefront to be distributed so as to achieve a uniform intensity across the wavefront. For the usual case at the entrance where a plane wave is incident in a direction parallel to the axes of the passages at their entrances, stagger of the entrances of the passages has no affect on performance.

BRIEF DESCRIPTION OF THE DRAWINGS

In describing the present invention, reference will be made to the accompanying figures of drawing in which:

FIG. 1 is a longitudinal cross section of both of two refracting structures which embody this invention. The view is taken on line 1—1 of FIG. 2 and on line 1—1 of FIG. 4. Line 2,4–2,4 will be considered to be line 2—2 on which FIG. 2 is taken and line 4—4 on which FIG. 4 is taken, and similarly for line 3,5–3,5.

FIG. 2 is an end view on line 2—2 of FIG. 1 of a refractor designed to refract a plane wave into an approximately hemispherical wave.

FIG. 3 is a transverse cross section of the structure of FIG. 2 on line 3—3 of FIG. 1.

FIG. 4 is an end on view on line 4—4 of FIG. 1 of a refractor designed to refract a plane wave into a cylindrical wave, where the refractor is shown oriented for horizontal dispersion of the refracted wave, as it would normally be in actual use.

FIG. 5 is a transverse cross section of the structure of FIG. 4 on line 3—3 of FIG. 1.

FIG. 6 is a longitudinal cross section of a third refracting structure which embodies this invention. The view is taken on line 6—6 of FIG. 7 and on line 6—6 of FIG. 8.

FIG. 7 is an end on view on line 7—7 of FIG. 6 of a refractor designed to refract a plane wave into a spherical wave.

FIG. 8 is a transverse cross section of the structure of FIG. 7 taken on line 8—8 of FIG. 6.

FIG. 9 is a geometric diagram of a thought experiment designed to analyse a prism refracting structure with non-staggered passage exits.

FIG. 10 is a geometric diagram of a thought experiment designed to analyse a prism refracting structure which has the exit ends of its passages staggered so as to avoid discontinuities in the sound path cross sectional area upon refraction.

FIG. 11 is a geometric diagram of a thought experiment designed to analyse a divergent refractor designed so that each passage contributes its proportionate share to the refracted wavefront.

DESCRIPTION OF THE PREFERRED EMBODIMENTS

Referring to FIG. 1, plane sound waves 20 are shown entering the refractor in a direction parallel to the direction that the sound passages 21 have at their entrances 22. The sound emerges from the staggered exits 23 of the passages and because of the varying amounts of delay produced by the bends in the passages is refracted into curved waves 24 upon emergence.

The wavelets emerging from each passage individually diffract outward in all directions if the exit ends of the passages are smaller than half a wavelength, and the interference produced in combination by neighboring wavelets results in refraction in a given direction for any given neighborhood of the exit aperture of the lens. If the exit ends of the passages were not small enough for sound to diffract over a wide angle, then satisfactory refraction could not be obtained over a wide angle. For the central passages of the refractor of FIG. 1 the refraction angle is not large, and accordingly the widths of the central passages could be somewhat wider than a half a wavelength, if desired. The passage width required for diffraction over a given angle can be determined from Fraunhofer diffraction from a single slit.

FIG. 2 and FIG. 3 illustrate an approximately spherically divergent lens having passages with square cross sections 21*a* and entrances 22*a*. Hexagonal shapes, or even an assortment of shapes that fitted together like a jigsaw puzzle at the ends could be used, so long as the appropriate dimension of each shape be smaller than half a wavelength.

In FIG. 3, the vertical and horizontal separations of the passages each correspond to that which would be used to produce cylindrical wavefronts with the same degree of divergence. Equal horizontal and vertical divergence is thus achieved with an approximately spherical wavefront. A more exact approximation to a spherical wave front is certainly possible but is not worth the trouble.

In similar fashion, the vertical and horizontal separations could have been arranged to correspond to cylindrical wave fronts with different amounts of divergence in order to produce what is commonly referred to in the industry as an elliptical dispersion characteristic.

Aside from considerations of cost, a fundamental limitation on how small in cross section the passages may be is provided by the well known attenuation of sound in small tubes.

FIG. 4 and FIG. 5 illustrate a cylindrically divergent lens where slit shaped passages 21*b* with slit shaped entrances 22*b* have been employed to take advantage of the symmetry, thus reducing the number of passages below the number that would be required if square cross section passages were used. This simplification is possible because refraction takes place only in a direction perpendicular to the long dimension of each slit, or horizontally in FIG. 4 and FIG. 5. The wavelets emerging from the slits are reasonably nondirectional in the direction of refraction if the narrow dimension of the slits is less than half a wavelength at the highest frequency to be refracted. The fact that the wavelets are highly directional vertically does not interfere with the refraction because there is no vertical component of the refraction.

This example is described in the rectangular coordinates "vertically" and "horizontally", but a similar situation can arise in cylindrical coordinates for a spherical wave refractor with circumferential slits and radial refraction, such a structure being made of concentric shells, each a figure of revolution, as shown in FIG. 6, FIG. 7, and FIG. 8. Vanes 25 provide relative positioning of the shells, as shown in FIG. 7 and FIG. 8. Each slit is arranged to have constant cross sectional area throughout its length by compensating for variations of circumference with variations of width as shown in FIG. 6. In this example, refraction takes place in different directions at different points around an exit slit, but is at every point radial, so that the width at any point of an exit slit measured in the plane of refraction at that point is less than half a wavelength.

The design of FIG. 6 could have been made more compact by resorting to right angle bends, with the passages everywhere being either radial or axial in direction, but at the price of higher reactance at sharp bends for shorter wavelengths.

The design of refractors is best understood by consideration of examples. The design approach is to decide what waveshape is to be radiated from the refractor, then in a thought experiment, reverse the direction of travel of the emergent wavefront to see what happens to it upon entering the exit end of the refractor. As an example of this kind of thought experiment, FIG. 9 shows a cross sectional view of the exit end of a prism and the desired emergent refracted wave front 26. The arrows show the path that the wavefront would take upon re-entering the prism. The length of each arrow is the same, since distance traveled by all parts of the wave front in a given time interval is the same. The depth of penetration into the prism is different for different parts of the wavefront because of the geometry of the situation, so the arrowheads are not lined up side by side. Before the wavefront has penetrated through to the entrance, the arrowheads must be made to line up side by side so as to correspond to the normally incident plane wave desired at the entrance. The dotted portion of each arrow up to the back of each arrowhead shows the internal delay required in each passage in order to line up the arrowheads.

The case of FIG. 9 has the disadvantage that there is a large discontinuity in the cross sectional area of the sound path at the exit end of the refractor. Discontinuities in the cross sectional area of the sound path cause reflections, which can result in degraded performance. This is overcome by the construction of FIG. 10, where stagger of the exit ends of the passages has been employed to maintain the same cross sectional area of the sound path inside and outside the refractor. When the cross sectional area of the passage boundaries is negligible, the angle of stagger required to achieve this equality of sound path cross section is equal to half the angle of refraction, as in the case of FIG. 10. If the angle of stagger were increased further until it was equal to the angle of refraction, the discontinuity in sound path area upon refraction would be just as severe as in the case of FIG. 9.

A corollary of the fact that the stagger angle is half the refraction angle in the construction of FIG. 10 is the fact that the refracted wave 27 is equal to the reflected wave that would result if a membrane were stretched tightly over the staggered ends of the passages, and a plane wave were incident on the membrane from the exterior of the structure travelling in a direction parallel to the axes of the passages at their exit ends. The delay for each given passage of a refractor which is to be equivalent to a reflector is twice the time interval between the time when the imaginary plane wave strikes the first passage that it strikes, and the time that it strikes the given passage. The form of the desired emergent wave does not enter into the design.

Returning to the time reversal method of designing refractors based on the desired emergent wave, consider the case of FIG. 11. The desired emergent wave 28 is shown re-entering the refractor. The boundaries between passages have been extended the precise distance required so that as the semicircular wave front 28 converges to its center, the exit end of each passage intercepts an equal angular sector of the wavefront. The resulting degree of stagger is substantially, but not seriously, different from that which would yield no discontinuity in sound path cross section at the exit.

The stagger and delay derived from FIG. 11 is employed in FIG. 1 and FIG. 6. The delays in FIG. 1 and FIG. 6 are the same in spite of the difference in length and shape of corresponding passages. The delay is the difference between the length of a passage and the straight line distance between its entrance and exit. The central passages are straight and therefore have no delay.

Stagger has no effect where the wave front exterior to the ends of the passages is perpendicular to the axes of the passages at their ends, as at the entrance of FIG. 1 and FIG. 6. Thus the entrances in each case could have been staggered so as to make the lengths of all the passages the same without affecting the delays of the passages or the lens performance.

In the construction of FIG. 11, it was assumed that the sound source to be used with the refractor would provide a plane wave with equal intensity across the wave front. While this is a good approximation for most horns and electrostatic loudspeakers that are likely to be used with such a refractor, it may not always be the case. If the source intensity were greater at the center and less at the edges, less stagger would be employed in the construction of FIG. 11 to apportion more of the reentrant wave to the center passages.

A lens with slowly varying cross sections of the passages could be used to advantage with a horn, by comprising the mouth of the horn, possibly shortening by as much as 30% the overall length required to achieve a given mouth area when compared to the alternative of a horn with a non-tapered lens in front of the horn mouth.

No sudden or gradual change in cross section greater than 10% should take place within any shorter interval than the distance required for a 10% change in cross section of an exponential horn designed for use down to as low a frequency as the refractor is to be used. If the passages meet this criterion, then their cross sections may be considered to vary slowly to avoid serious reflections even though the variations be accomplished in a series of abrupt changes in cross section, each of less than 10% adequately spaced apart.

If it is required that a refractor avoid large discontinuities in cross section at both ends, and that the passages not exceed a slow variation in cross section, then it seems that in cases of practical interest that the different delays of various portions of the sound path required for refraction can only be achieved by sound paths with certain characteristics. Namely, that somewhere between the clustered ends, some adjacent passages must be separated from each other and follow paths of different shapes. This does not mean simply that in this region the passages must be shaped differently, as with differently tapered cross sectional areas, but that the paths followed by the passages must be shaped differently, in the sense that one path could not be laid on top of another so as to match, if they are to have different delays for their respective parts of the sound path.

Various techniques of manufacture are applicable to the refractor of FIG. 1, FIG. 2, and FIG. 3. A bundle may be formed of flexible strips, each having the square cross section desired in the passages of the divergent lens. If both ends of the bundle are loosely held in fixed clamps, by pushing both ends of the bundle toward the middle, the bundle may be made to spring out in the desired shape, if the outer strips are pushed farther than the inner ones, and the innermost one not at all. If the clamps are then tightened, the lens may be molded about the bundle in a mold. After the lens has hardened, one end of the bundle may be unclamped, and the bundle pulled out by the other end. If precise stagger were desired, spacer ribbons attached to the ends of the strips could provide this. If the particular situation resulted in strips touching one another near the clamps, they could be kept apart by suitable pins inserted in a small passage in the center of each strip. The pins would be inserted in the ends of the strips with the inner strips having the pins in the farthest, and the very outer layer of strips having no pins.

Of course, for the very most precise and repeatable results, the lens could be molded about a bundle of rigid strips that were meltable or dissolvable.

The lens of FIG. 1, FIG. 4, and FIG. 5 could be molded by conventional means in sections and assembled together, as could the lens of FIG. 6, FIG. 7 and FIG. 8.

I claim:

1. An acoustic refractor consisting of a structure provided with an entrance aperture, an exit aperture, a plurality of separate and distinct sound passages connecting said entrance and exit apertures, the path followed by each said sound passage being such that the direction of said path at the passage entrance is parallel to the direction of propagation of the portion of a sound wave that enters the passage, the refractor being designed to refract said sound wave, said passage having a nondecreasing cross sectional area throughout its length, said passage being provided with any single value of delay required for the desired refraction, said delay being the difference between the length of the passage and the straight line distance between the ends of the passage, said delay being accomplished by increasing the average separation between adjacent passages over what it would be if they were both straight, said separation being provided by the portion of the structure between said adjacent passages, each said passage having an exit end such that at any point on said exit end the width of the passage measured in the plane of refraction at said point is small enough to provide means producing diffraction without a null in the diffraction pattern throughout the entire angle of refraction at said point, said angle of refraction being the angle between the direction of the passage and the direction of the refracted wave at said point.

2. A refractor as in claim 1 with passages having cross sections in the form of straight slits.

3. A refractor as in claim 1 with passages having cross sections in the form of concentric circular slits.

4. A refractor as in claim 1 with passages having cross sections which have no dimension greater than half a wavelength at the highest frequency to be refracted.

5. An acoustic refractor as in claim 1 having the exit ends of the passages staggered so that the proportion of the total sound energy in the refracted wave that would reenter each passage if the direction of propagation of the refracted wave were reversed is the same as the proportion of the total sound energy intercepted at the entrance of each corresponding passage when the direction of propagation is not reversed, said stagger providing means permitting uniform dispersion of sound over wide angles with a minimum of reflections.

6. An acoustic refractor as in claim 1 with each passage having constant cross sectional area throughout its length.

7. A refractor as in claim 5 with passages having cross sections in the form of straight slits.

8. A refractor as in claim 5 with passages having cross sections in the form of concentric circular slits.

9. A refractor as in claim 5 with passages having cross sections which have no dimension greater than half a wavelength at the highest frequency to be refracted.

10. A refractor as in claim 6 with passages having cross sections in the form of straight slits.

11. A refractor as in claim 6 with passages having cross sections in the form of concentric circular slits.

12. A refractor as in claim 6 with passages having cross sections which have no dimension greater than half a wavelength at the highest frequency to be refracted.

13. An acoustic refractor as in claim 6 having the exit ends of the passages staggered so that the proportion of the total sound energy in the refracted wave that would reenter each passage if the direction of propagation of the refracted wave were reversed is the same as the proportion of the total sound energy intercepted at the entrance of each corresponding passage when the direction of propagation is not reversed, said stagger providing means permitting uniform dispersion of sound over wide angles with a minimum of reflections.

14. A refractor as in claim 1 with passages having cross sections in the form of straight slits.

15. A refractor as in claim 13 with passages having cross sections in the form of concentric circular slits.

16. A refractor as in claim 13 with passages having cross sections which have no dimension greater than half a wavelength at the highest frequency to be refracted.

* * * * *